US005593328A

United States Patent [19]

Okada et al.

[11] Patent Number: 5,593,328

[45] Date of Patent: Jan. 14, 1997

[54] FEMALE TERMINAL FITTING FOR CONNECTOR

[75] Inventors: Hajime Okada; Masahiko Aoyama; Tomonari Ito, all of Yokkaichi, Japan

[73] Assignee: Sumitomo Wiring Systems, Ltd., Yokkaichi, Japan

[21] Appl. No.: 332,084

[22] Filed: Nov. 1, 1994

[30] Foreign Application Priority Data

| | | | |
|---|---|---|---|
| Nov. 4, 1993 | [JP] | Japan | 5-064261 U |
| Nov. 15, 1993 | [JP] | Japan | 5-065966 U |
| Nov. 24, 1993 | [JP] | Japan | 5-067563 U |
| Dec. 22, 1993 | [JP] | Japan | 5-073558 U |

[51] Int. Cl.[6] ..... H01R 11/22

[52] U.S. Cl. ..... 439/851; 439/843

[58] Field of Search ..... 439/842–845, 439/849, 850–856, 861, 862, 636, 637, 833, 839

[56] References Cited

U.S. PATENT DOCUMENTS

| | | | |
|---|---|---|---|
| 4,193,660 | 3/1980 | Jaconette | 339/191 R |
| 4,560,231 | 12/1985 | Shirai | 439/851 |
| 4,579,409 | 4/1986 | Enneper et al. | 439/845 |
| 4,690,478 | 9/1987 | Rahrig et al. | 439/851 |
| 4,813,881 | 3/1989 | Kirby | 439/74 |
| 5,092,783 | 3/1992 | Suarez et al. | 439/862 |

FOREIGN PATENT DOCUMENTS

| | | |
|---|---|---|
| 2415890 | 8/1979 | France . |
| 63-26979 U | 2/1988 | Japan . |
| 5-205804 | 8/1993 | Japan . |
| 6-60931 | 3/1994 | Japan . |
| 1584571 | 2/1981 | United Kingdom . |

*Primary Examiner*—David L. Pirlot
*Attorney, Agent, or Firm*—Oliff & Berridge

[57] ABSTRACT

A female terminal fitting for a connector comprises: a cylindrical insertion portion whose front and is opened; and a resilient contact piece is disposed within the cylindrical insertion portion. The resilient contact piece includes: a first fold being formed by extending an extending end portion from a wall portion of the cylindrical insertion portion and folding the extending end portion back into a hollow of the cylindrical insertion portion, the first fold being given resiliency; a second fold being formed by further folding the extending end portion inward, the second fold being given resiliency; and a stopper for regulating an amount of flexion of the resilient contact piece, the stopper being formed by bending the extending end portion of the second fold so as to confront a back surface between the first fold and the second fold. A male terminal fitting is retained in pressure contact with the resilient contact piece by inserting the male terminal fitting into the cylindrical insertion portion.

7 Claims, 10 Drawing Sheets

FEMALE TERMINAL FITTING FOR CONNECTOR

BACKGROUND OF THE INVENTION

1. Field of Invention

The present device relates to a female terminal fitting for a connector, which has a cylindrical insertion portion whose front end is opened and which is connected to a mating male terminal fitting by allowing the male terminal fitting to be inserted into the cylindrical insertion portion.

2. Description of Prior Art

A connector adapted for use in connecting electrical wires is designed to attach a male terminal fitting to one of a pair of connectors to be connected to each other and a female terminal fitting to the other, and to insert the male terminal fitting to a cylindrical insertion portion of the female terminal fitting formed by opening the front end of the female terminal fitting, so that both male and female terminal fittings can be connected to each other electrically.

The female terminal fitting has the cylindrical insertion portion formed by bending a metal strip in cylindrical form and a fold formed by folding a part of the metal strip from the front end opening of the cylindrical insertion portion toward the hollow so as to depict a loose arc. A resilient contact piece that is given resiliency is disposed on the fold. One known example is a device shown in FIGS. 19, 20 which is disclosed in Japanese Unexamined Utility Model Publication No. 63-26979, and another is shown in FIG. 21. Each of these female terminal fittings 50 is constructed so that a resilient contact piece 53 extends rearward by folding the slenderly extending resilient contact piece 53 from the front end opening 52 of a cylindrical insertion portion 51 into the hollow, and causes a not shown male terminal fitting to come in contact with the female terminal fitting by clamping the male terminal fitting between the cylindrical insertion portion 51 and an inner wall 54 thereof by resiliency of the resilient contact piece 53.

Further, as shown in FIG. 22, another example, which is characterized as arranging a second fold 57 formed by folding the front end of the resilient contact piece 53 so as to depict a loose arc, is known. Exhibiting resiliency not only at a first fold 56 but also at the second fold 57 on the extended end, such doubly folded resilient contact piece 53 has an excellent spring characteristic. That is, the male terminal fitting can be inserted with ease by a small insertion force and, in addition, once the male terminal fitting has been inserted, the contact pressure is so high as to ensure excellent contact reliability.

The resilient contact piece 53 is given resiliency by bending a metal strip. Therefore, if a flexing force exceeding the limit of resiliency is applied to the resilient contact piece 53, i.e., if a foreign object that is thicker than the male terminal fitting (e.g., the tip of a screwdriver) is inserted, or if the male terminal fitting is inserted obliquely, the resilient contact piece 53 settles to lose the proper spring characteristic thereof. To prevent such settling, a stopper has heretofore been arranged on the resilient contact piece 53. In the female terminal fitting shown in FIG. 20, stoppers 60 formed by bending projecting pieces arranged on both sides of the resilient contact piece 53 perpendicularly are provided. The lower end portions thereof are abutted against the bottom surface of the cylindrical insertion portion.

The female terminal fitting shown in FIG. 21 has a stopper 61 that is prepared by forming a projection while cutting a part of the wall portion facing the back of the resilient contact piece 53 and bending such projection upward so as to correspond to the back of the resilient contact piece 53.

Another conventional terminal fitting of this type having, as shown in FIG. 23, a cylindrical contact portion 101 at the front part thereof and a crimping portion 102 for crimping an electrical wire at the rear part thereof has heretofore been known. This terminal fitting is formed cubically by first cutting a developed blank out of a flat metal strip and then bending portions of such developed blank as necessary. A bottom wall 103 of the contact portion 1 is formed by cutting with a band-like metal piece left in the front and by bending the rear end thereof upward, so that the bank-like metal piece forms a flexible tongue piece 4 that projects from the bottom wall side to the ceiling wall side within the cylinder. The flexible tongue piece 104 is designed to cause a male terminal fitting to be biased onto the ceiling wall when the male terminal fitting is inserted into the cylinder. On the other hand, a reinforcing piece 105 that is formed by cutting the middle portion of the bottom wall 101 and bending the cut piece upward is designed to prevent the flexible tongue piece 104 from flexing excessively downward.

Still further, another conventional female terminal fitting for a connector which is attached to the connector and connected to a male terminal fitting of a mating connector is shown in FIG. 24. This female terminal fitting 340 is fabricated by bending a metal strip piece punched into a predetermined shape, and has a cylindrical insertion portion 341 whose front end is opened serving as an insertion opening 342. A resilient contact piece 345 is disposed within the cylindrical insertion portion 341. The resilient contact piece 345 is given resiliency by a fold **345*a* with a portion slenderly extending from the front end of a lower wall plate 343 constituting the cylindrical insertion portion 341 folded rearward. The thus constructed female terminal fitting 340 is inserted into a cavity 351 formed in a connector 350 from the rear and unreleasably attached to the connector 350 by a lance 353 with an insertion opening 342 thereof aligned with a connecting opening 352 formed at the front end of the connector 350**.

At the time the female terminal fitting 340 attached to the connector 350 is connected to the male terminal fitting attached to the mating connector (not shown), a tab 355 projecting from the front end of the male terminal fitting enters into the cylindrical insertion portion 341 while sequentially passing through the connecting opening 352 and the insertion opening 342 of the female terminal fitting. Then, the tab 355 is then clamped between the upper surface of the resilient contact piece 345 and the upper wall surface 346 of the cylindrical insertion portion 341, both surfaces as viewed in FIG. 24, by resiliency of the resilient contact piece 345. As a result, the male terminal fitting is reliably connected electrically to the female terminal fitting 340.

In the aforementioned connecting means the connecting opening 352 of the connector 350 has so large an opening as to allow the tab 355 of the male terminal fitting to be releasably inserted, whereas the insertion opening 342 of the cylindrical insertion portion 341 has an opening larger than that of the connecting opening 352 so as to be opened over almost all the front end surface of the cylindrical insertion portion 341.

As a result, a foreign object such as, e.g., the tip of a screwdriver which is thicker than the tab 355 may, in some cases, be inserted into the cylindrical insertion portion 341 from the connecting opening 352, or the tab 355 may be inserted obliquely as shown in FIG. 24. In such a case, the fold 345*a* of the resilient contact piece 345 flexes to such a degree as to exceed the limit of resiliency thereof and settling occurs due to such excessive flexion, so that the proper spring characteristic of the resilient contact piece 345 is lost. Once the proper spring characteristic has been lost, the resilient contact piece 345 cannot clamp the inserted tab 355 together with the upper wall surface 346 at a predetermined contact pressure, thus not providing reliable contact between the male terminal fitting and the female terminal fitting 340.

To prevent the resilient contact piece 345 from losing the proper spring characteristic thereof, a stopper 348 has conventionally been provided. The front end of the stopper 348 is formed so as to confront the lower surface of the resilient contact piece 345 by bending a part of the lower wall plate 343 of the cylindrical insertion portion 341 upward.

This stopper 348 prevents excessive flexion of the resilient contact piece 345. That is, when the resilient contact piece 345 resiliently flexes, the lower surface of the resilient contact piece 345 is abutted against the front end of the stopper before the amount of flexion thereof exceeds the limit of resiliency thereof. As a result, resilient deformation of the resilient contact piece 345 more than such limit of resiliency is blocked, thereby preventing the excessive flexion of the resilient contact piece 345. Hence, the proper spring characteristic of the resilient contact piece 345 is maintained, and the male terminal fitting can come in contact with the female terminal fitting 340 reliably.

In the conventional female terminal fittings, for instance shown in FIGS. 19, 30, the former stoppers 60 project sideways by a bending margin g that is equal to the thickness of the resilient contact piece as shown in FIG. 20. Therefore, it is required that the width of the resilient contact piece 53 be smaller at least by a bending margin 2*g* within the limited width of the cylindrical insertion portion, and this in turn prevents the resilient contact piece 53 from having a large resiliency. If the stopper is bent so as not to project sideways by the bending margin g in FIG. 20, then the stopper must be bent by nicking the resilient contact piece in the width direction by the bending margin g, which also prevents the resilient contact piece 53 from having a large resiliency. As a result, particularly small resilient contact pieces have been useless because of their insufficient resiliency.

When the stopper 61 shown in FIG. 21, i.e., the stopper formed by cutting a part of the wall portion is applied to the resilient contact piece 53 that has the first and second folds 56, 57 shown in FIG. 6, the cylindrical insertion portion becomes fragile. Therefore, such design has not been applicable to particularly small resilient contact pieces.

Although provided with the reinforcing piece 105, the aforementioned conventional terminal fitting as shown in FIG. 23 is deformed when the force biasing the flexible tongue piece 104 is so large. As a result, the flexible tongue piece 104 flexes so excessively as to lose the sprint characteristic thereof. In addition, the reinforcing piece 105 is displaced due to a return ensuring the machining operation when formed by cutting and bending upward, and this makes it difficult to place the reinforcing piece 105 in correct position during fabrication.

Furthermore, the conventional stopper 61 as shown in FIG. 21 is formed by bending the thin plate substantially perpendicularly, so that a biasing force is applied to the plate edge thereof by the resilient contact piece 53. As a result, when a large biasing force is applied to the stopper 61, the stopper 61 may, in some cases, be so inclined as to lose the function thereof. Particularly, small-sized female terminal fittings have addressed the problem that the stopper thereof is easily inclined, because the material of which the stopper is made is thin.

The conventional method of blocking the excessive flexion of the resilient contact piece 345 by arranging the stopper 348 also has addressed the following problems.

When a foreign object is inserted into the cylindrical insertion portion with a large force, the stopper 348 may be broken while inclined by the biasing force from the resilient contact piece 345 side, or the resilient contact piece 345 made of a thin metal plate may be bent. Particularly, small-sized female terminal fittings 340, in which the metal strip used as a material is thin, are easy to cause such problem.

As a result, the resilient contact piece 345 is subjected to settling to lose the proper spring characteristic thereof or to hamper smooth insertion.

The present device has been made in consideration of the aforementioned circumstances.

SUMMARY OF THE INVENTION

The first object of the present invention is to provides a female terminal fitting having a stopper at a doubly folded resilient contact piece, the stopper being capable of preventing settling of the resilient contact piece without losing the rigidity of a cylindrical insertion portion and the spring characteristic of the resilient contact piece.

The second object of the invention provides a terminal fitting that can improve not only the rigidity of the reinforcing piece but also the positional accuracy thereof.

The third object of the invention provides a female terminal fitting for a connector which can reliably prevent setting of a resilient contact piece by arranging a highly rigid stopper.

The fourth object of the invention to provides a female terminal fitting for a connector which can ensure reliable connection to a male terminal fitting by preventing a resilient contact piece from losing the proper spring characteristic thereof or preventing deformation of the resilient contact piece.

In order to achieve the first object, the present invention provides a female terminal fitting for a connector comprising: a cylindrical insertion portion whose front end is opened; and a resilient contact piece is disposed within the cylindrical insertion portion. The resilient contact piece includes: a first fold being formed by extending an extending end portion from a wall portion of the cylindrical insertion portion and folding the extending end portion back into a hollow of the cylindrical insertion portion, the first fold being given resiliency; a second fold being formed by further folding the extending end portion inward, the second fold being given resiliency; and a stopper for regulating an amount of flexion of the resilient contact piece, the stopper being formed by bending the extending end portion of the second fold so as to confront a back surface between the first fold and the second fold. A male terminal fitting is retained in pressure contact with the resilient contact piece by inserting the male terminal fitting into the cylindrical insertion portion.

To accomplish the second object, a terminal fitting comprising: side walls formed by bending both side portions of a bottom wall of a portion coming in contact with a mating terminal upright so that the contact portion is surrounded in three directions; a reinforcing piece formed by cutting and bending upright a portion of the bottom wall; projections formed on sides of the reinforcing piece and; recesses engageable with the projections formed on portions of the side walls confronting said projections.

To achieve the third object, the invention provides a female terminal fitting for a connector comprising: a cylindrical insertion portion into which the male terminal fitting is inserted from a front end opening of the cylindrical insertion portion; a resilient contact piece serving to clamp the male terminal fitting together with an inner wall of the cylindrical insertion portion; and a stopper serving to regulate an amount of flexion of the resilient contact piece. The stopper that is C-shaped in section by a support surface and support pieces at both sides of the support surface is arranged so as to project from a wall of the cylindrical insertion portion or from the resilient contact piece.

In order to achieve the fourth object, the invention provides a female terminal fitting for a connector, the connector having a connecting opening, the female terminal fitting comprising: a cylindrical insertion portion having an insertion opening formed at a front end thereof and containing a resilient contact piece therein, the female terminal fitting being electrically connected to a male terminal fitting of a mating connector by allowing the male terminal fitting of the mating connector to be inserted into the cylindrical insertion portion via the connecting opening of the connector and the insertion opening while connected to the connector; and a regulating member for regulating a direction of insertion of the male terminal fitting into the cylindrical insertion portion, the regulating member being disposed at a position on the insertion opening side of the cylindrical insertion portion.

According to the invention, the resilient contact piece formed by extending the extending end portion from the wall portion of the cylindrical insertion portion and folding the extending end portion at the first fold has the extending end portion thereof further folded inward at the second fold, so that resiliency is given thereto. Therefore, a male terminal fitting can be inserted into the cylindrical insertion portion at a small insertion pressure, and a high contact pressure is given to the inserted male terminal fitting. Further, the stopper formed by bending the extending end portion of the second fold so as to confront the back surface between the first fold and the second fold. Therefore, even if an excessive biasing force is applied to the first fold, the back surface between the first fold and the second fold is abutted against the stopper so that the stopper regulates the excessive biasing force to an amount of flexion within the limit of resiliency allowed by the first fold. As a result, settling of the resilient contact piece can be prevented. Still further, the stopper is arranged so as to bend the extending end portion of the second fold. Therefore, no such arrangement as nicking the cylindrical insertion portion or the resilient contact piece or narrowing the width of the resilient contact piece is required in order to provide the stopper. As a result, the rigidity of the cylindrical insertion portion and the spring characteristic of the resilient contact piece are not lost.

Furthermore, according to the invention, the projections formed on the sides of the reinforcing piece formed by cutting and bending the bottom wall are engaged with the recesses on the confronting side walls, so that the side walls bear a part of the load applied to the reinforcing piece. In addition, the engagement of the projections with the recesses implements positioning of the reinforcing piece.

Still further, according to the invention, when a foreign object such as the tip of a screwdriver which is thicker than the standard male terminal fitting, the resilient contact piece flexes, and the flexion thereof is supported by the support surface of the stopper within the limit of resiliency of the resilient contact piece. Accordingly, the resilient contact piece is free from flexing to such a degree as to exceed the limit of resiliency thereof to be subjected to settling.

In addition, when a large force is applied to the foreign object, the stopper receives the large force through the resilient contact piece. At this time, the stopper, whose rigidity is increased while formed into a U-shaped member by the support pieces at both sides of the support surface, can support the resilient contact piece by the support surface with the support pieces inclined. Therefore, the resilient contact piece can be supported without breaking the stopper.

Still further, according to the invention, to connect the female terminal fitting attached to the connector, the male terminal fitting is inserted into the female terminal fitting from the connecting opening of the connector with the direction of insertion thereof regulated by the regulating member so as not to be inserted obliquely toward the resilient contact piece; i.e., the male terminal fitting is inserted in the axial direction and comes in resilient contact with the resilient contact piece.

As described in the foregoing, a resilient contact piece includes: a first fold being formed by extending an extending end portion from a wall portion of a cylindrical insertion portion and folding the extending end portion back into the hollow of the cylindrical insertion portion, the first fold being given resiliency; a second fold being formed by further folding the extending end portion inward, the second fold being given resiliency; and a stopper for regulating the amount of flexion of the resilient contact piece, the stopper being formed by bending the extending end portion of the second fold so as to confront the back surface between the first fold and the second fold. Therefore, the present device can provide a female terminal fitting that can prevent settling of the resilient contact piece without losing the rigidity of the cylindrical insertion portion and the spring characteristic of the resilient contact piece.

Furthermore, the present invention provides the reinforcing piece to be supported by the side walls. Therefore, not only the strength of the reinforcing piece itself is improved, but also the strength of the terminal fitting as a whole can be improved since the side walls are also supported by the reinforcing piece. In addition, the engagement of the reinforcing piece with the side walls serves to position the reinforcing piece, which in turn provides a terminal fitting capable of improving fabrication accuracy.

Still further, the present terminal fitting provides a highly rigid stopper by a support surface and support pieces at both sides of the support surface. Therefore, even if a foreign object is inserted from the front end opening of the cylindrical insertion portion to apply a large force to the stopper, the stopper is not broken and, therefore, can serve the function thereof. Accordingly, a female terminal fitting for a connector which can maintain the spring characteristic of the resilient contact piece can be obtained.

Still further, the present invention arranges the regulating member that regulates the direction of insertion of a male terminal fitting into the cylindrical insertion portion. Therefore, the present device can prevent such excessive flexion of the resilient contact piece as to cause the resilient contact piece to lose the spring characteristic thereof by oblique insertion of the male terminal fitting toward the resilient contact piece or by insertion of a foreign object that is thicker than the male terminal fitting.

DETAILED DESCRIPTION OF THE PREFERRED EMBODIMENTS

Figure 1:
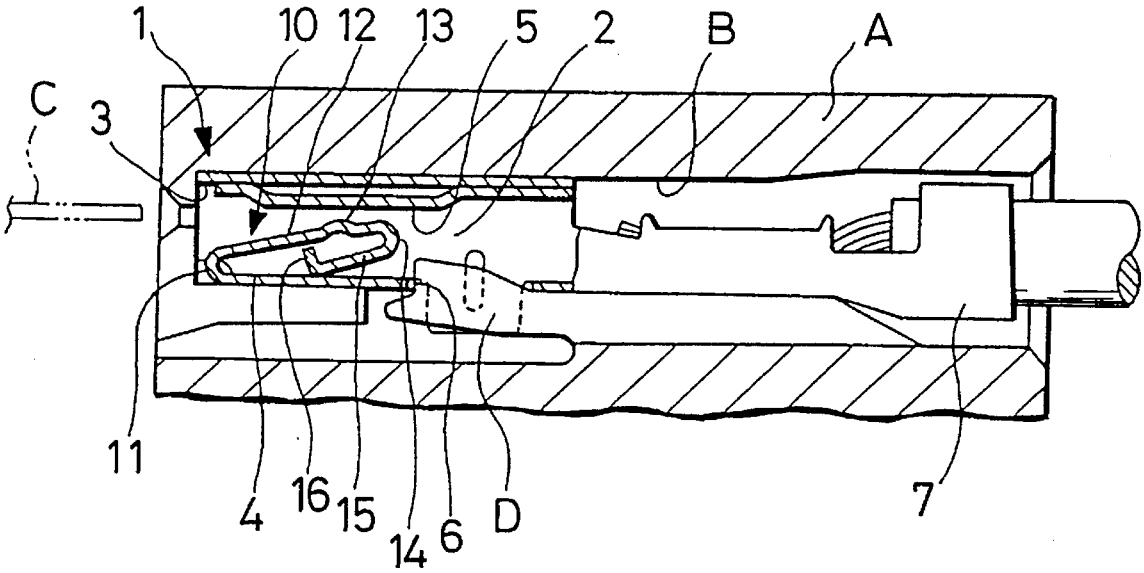
FIG. 1 is a partially cutaway side view of a female terminal fitting of the first embodiment.

A first embodiment of the present device will now be described hereinafter with reference to FIGS. 1 and 2.

A female terminal fitting 1, which is the first embodiment of the present device, is designed to be inserted into a cavity B of a connector housing A and electrically connected to a male terminal fitting while fitted with a tab C of the male terminal fitting attached to a mating connector housing (not shown).

The female terminal fitting 1 is formed by punching an electrically conducting metal strip into a predetermined shape and bending the punched blank at predetermined positions. A portion on the front end side constitutes a cylindrical insertion portion 2 that is square in section as a whole. The front end of the portion is open to the outside and serves as an insertion opening 3 of the tab C.

A resilient contact piece 10 is disposed within the hollow of the cylindrical insertion portion 2. The resilient contact piece 10 extends from a wall portion 4 on the lower side of FIG. 1 and is integrated with the female terminal fitting 1. The resilient contact piece 10 has a predetermined width that is slightly narrower than that of the hollow of the cylindrical insertion portion 2. The resilient contact piece 10 includes: a first fold 11 folded rearward from the front end edge of the wall portion 4 on the lower side; an extending portion 12 extending from the first fold 11 rearward so as to be slightly obliquely upward and having a contact projection 13 on the way; a second fold 14 formed by bending the extending portion 12 at the end edge thereof downward; and an extending end portion 15 extending from the second fold 14 further frontward. When the resilient contact piece 10 is in a free condition, a gap that is slightly narrower than the thickness of the tab C of the male terminal fitting is provided between the projection 13 of the resilient contact piece 10 and a wall portion 5 of the cylindrical insertion portion 2 on the upper side of FIG. 1.

A stopper 16 is provided integrally with the resilient contact piece 10. The stopper 16 is formed by extending the front end of the extending end portion 15 and bending such extending end portion 5 upward. The stopper 16 is almost at right angles to the extending portion 12, and the front end thereof confronts the back (the lower surface) of the extending portion 12 with a predetermined gap when the resilient contact piece 10 is in the free condition.

It should be noted that a lance hole 6 is formed on the wall portion 4 on the lower side of FIG. 1 which is in the rear of the resilient contact piece 10 so that a lance D disposed on the connector housing A can be engaged therewith. By engaging the lance D with the lance hole 6 when the female terminal fitting is inserted into the cavity B, the female terminal fitting 1 can be held within the cavity B unreleasably.

Further, a core where the coat of the electrical wire (not shown) is stripped is to be firmly secured to a portion 7 in the rear of the cylindrical insertion portion 2.

Next, a mode of operation of the first embodiment will be described.

When the tab C of the male terminal fitting is inserted into the cylindrical insertion portion 2 of the female terminal fitting 1, and as the tab C advances into the space between the resilient contact piece 10 and the upper wall portion 5 pushingly, the extending portion 12 of the resilient contact portion 10 is pressed down by the tab C. In the meantime, not only the first fold 11 of the resilient contact piece 10 flexes resiliently while increasing the radius of curvature of the bend thereof, but also the front end of the extending end portion 15 is abutted against the lower wall portion 4 to thereby cause the second fold 14 to resiliently flex while increasing the radius of curvature of the bend thereof. Thus, resiliency is applied by both folds, facilitating the male terminal fitting to be inserted at a small insertion pressure, and ensuring highly reliable contact with high contact pressure once the male terminal fitting has been inserted.

Figure 2:
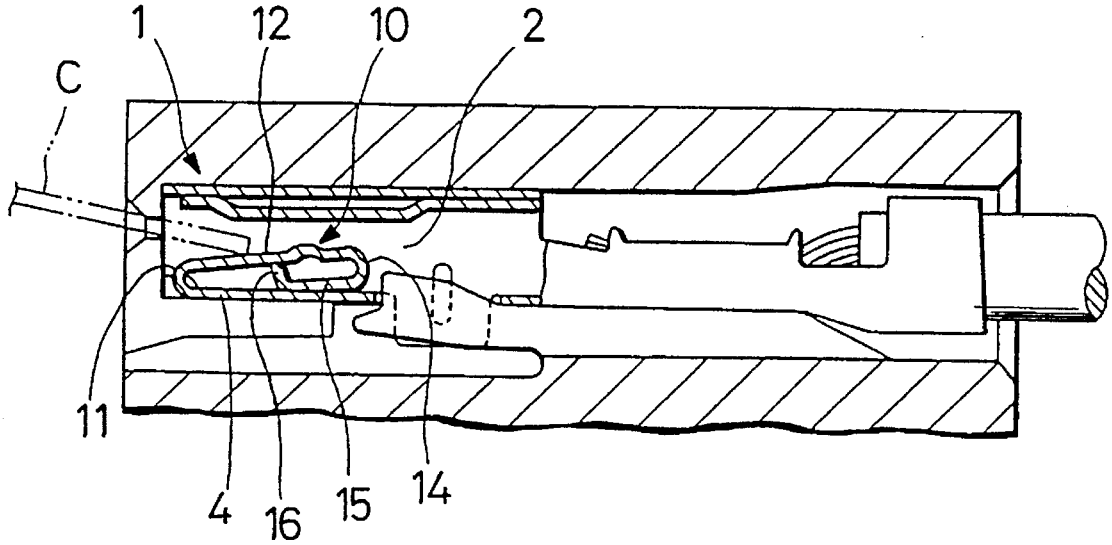
FIG. 2 is a sectional view with a stopper in operation of the female terminal fitting.

If the tab C of the male terminal fitting is inserted largely obliquely as shown in FIG. 2, or a foreign object such as the tip of a screwdriver which is thicker than the tab C of the male terminal fitting is inserted into the cylindrical insertion portion 2, a large flexing force is applied to the first fold 11.

However, this large flexing force is regulated to a range within which the first fold 11 can be resiliently deformed with the front end of the stopper 16 being abutted against the back of the extending portion 12 within the limit of resiliency of the first fold. As a result, permanent deformation of the resilient contact piece 10 can be prevented. Further, the aforementioned embodiment is thus arranged the stopper 16 so that the stopper 16 is abutted against almost in between the first fold 11 and the second fold 14. Therefore, excessive flexion of not only the first fold 11 but also the second fold 14 can also be regulated.

With respect to the condition of the extending end portion 15 at this time, it should be noted that the whole part thereof may come in intimate contact with the lower wall portion 4 as shown in FIG. 2, or only the front end thereof may be abutted against the lower wall portion. In either condition, the stopper 16 similarly blocks the excessive deformation of the resilient contact piece 10.

As described above, the stopper 16 regulates the deformation of the resilient contact piece 10 as long as the amount of flexion of both folds 11, 14 of the resilient contact piece 10 is within the limit of resiliency thereof. Therefore, it is no likelihood that the proper spring characteristic of the resilient contact piece 10 will be lost due to settling of the resilient contact piece 10 caused by the resilient contact piece 10 flexing to such a degree as to exceed the limit of resiliency thereof.

A second embodiment of the present invention will now be described with reference to the drawings.

Figure 3:
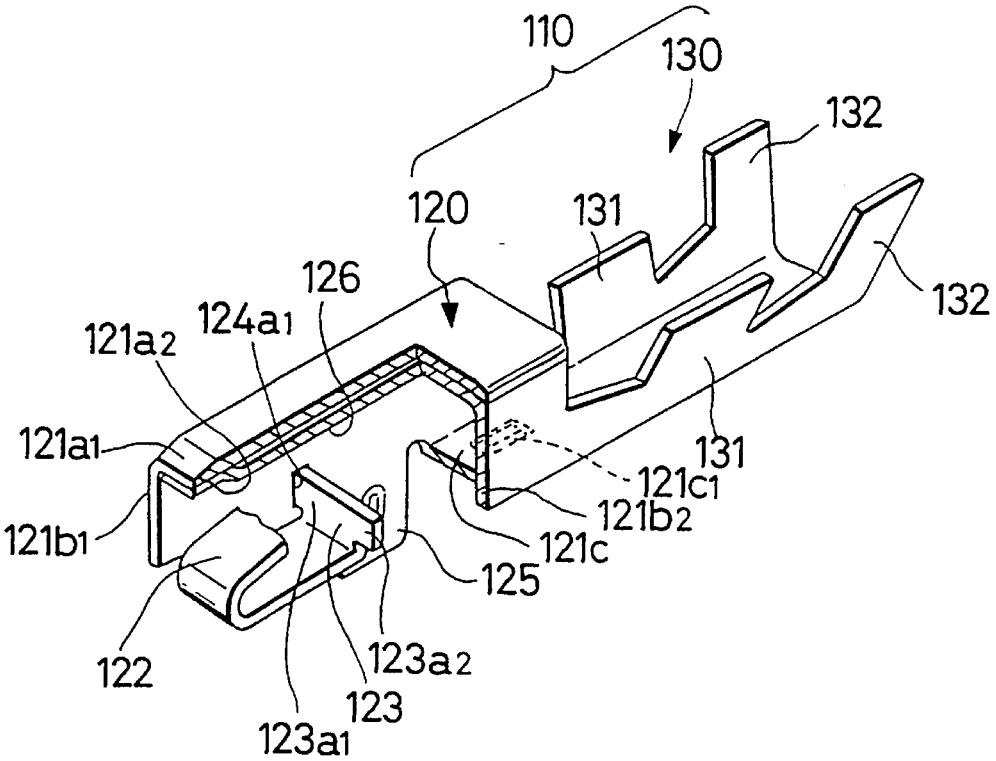
FIG. 3 is a partially cutaway perspective view of a terminal fitting according to the second embodiment of the present invention.
Figure 4:
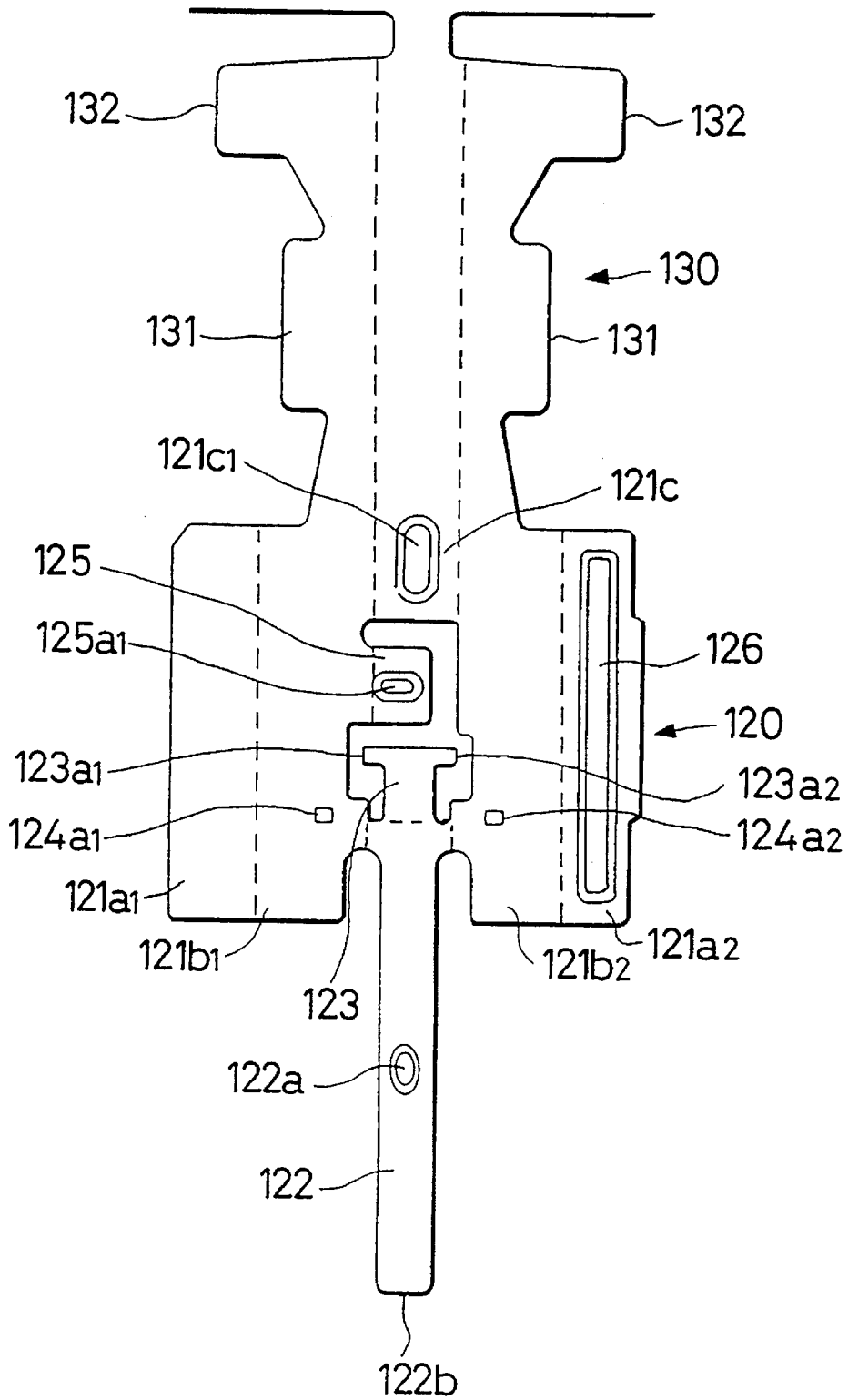
FIG. 4 is a development of the terminal fitting.

FIG. 3 is a partially cutaway perspective view of a terminal fitting, which is an embodiment of the present device; and FIG. 4 is a development of the terminal fitting.

As shown in the development, the terminal fitting 110 is prepared by first pouching a flat metal strip by press working to have projections and recesses, and then gradually fabricating the thus punched piece into a cubic piece in a subsequent process. It should be noted that the embodiment of the present device is assumed to be a small-sized fitting. Thus, the terminal fitting is formed using tin-plated phosphor bronze so that the spring force of the terminal fitting can be improved even though the terminal fitting is as thin as 0.2 mm or so. To compensate for the lower conductivity of tin-plated phosphor bronze compared with that of copper, a high strength copper may be employed. Because of such small thickness, brass that is too soft is not suitable. Stainless steel, which is not only too expensive and hard to machine, but also has low conductivity, is not suitable, either.

The flat metal strip is bent along a one dot chain line. A contact portion 120 forms a cylindrical member together with double ceiling walls 121*a*1, 121*a*2, both side walls 121*b*1, 121*b*2, and a bottom wall 121*c*. A band-like portion extends frontward continuously from the front end of the bottom wall 121*c* and a flexible tongue piece 122 having a spring characteristic is formed by folding the band-like portion rearward. The tongue piece 122 is folded rearward by approximately 180° at the continuous portion of the bottom wall 121*c*, has a slightly bent portion so as to be hill-like in the middle thereof, and has an oval projection 122*a* formed in the middle in the width direction of the slightly bent portion.

If no projection 122*a* is formed, burrs remain along the periphery of the tongue piece 122. Although it is likely that the terminal fitting having such burrs will come in contact with the sharp burrs and be connected, the presence of the projection 122*a* excludes such likelihood and ensures contact in the middle part that is relatively flat. The front end 122*b* of the tongue piece 122 is formed so as to slightly rise, so that the front end 122*b* comes in contact with the rear end side of the bottom wall 121*c* while folded back by 180°. A rectangular projection 121*c*1 is formed at a portion of the bottom wall 121*c* which is abutted against the front end 122*b*, so that front end 122*b* comes in slidable contact with the bottom wall 121*c* on the projection 121*c*1, although the bottom wall 121*c* tends to collapse while bent at the time of bending the side walls 121*b*1, 121*b*2 upward. When the bottom wall 121*c* has collapsed, both corners of the front end 122*b* come in contact with the projection 121*c*1, which hampers smooth sliding and hence disturb electrical stability. In addition, the tongue piece 122 is supported by both the bent portion on the front end side and the sliding contact portion on the rear end side, so that the tongue piece 122 can exhibit a better spring characteristic than one supported only by the bent portion on the front end side so as to be cantilevered.

Portions that are on both sides of the portion continuous to both the tongue piece 122 and the bottom wall 121*c* as well as continuous to the side walls 121*b*1, 121*b*2 are deeply cut on the rear side thereof. Such cut piece causes the center of gravity of the folded portion of the tongue piece 122 to move rearward, making the bent portion long. This is why a good spring characteristic can be obtained.

In the middle of the bottom wall 121*c* are two cut pieces. One of the cut pieces is a reinforcing piece 123, formed by cutting the bottom wall 121*c* so as to project toward a side opposite to the tongue piece 122. Engagement portions 123*a*1, 123*a*2 projecting sideways are formed at both corners of the front end. When the reinforcing piece 123 is bent upward, the engagement projections 123*a*1, 123*a*2 move in an upper front direction with respect to the position at which the reinforcing piece 123 is continuous to the bottom wall 121*c*. At positions on the side walls 121*b*1 and 121*b*2 where both engagement projections 123*a*1 and 123*a*2 under such condition confront when the side walls 121*b*1 and 121*b*2 are bent upward are engagement recesses 124*a*1 and 124*a*2. It should be noted that the engagement projections 123*a*1 and 123*a*2 and the engagement recesses 124*a*1 and 124*a*2 are punched out by press working and, therefore, positioning accuracy thereof is high.

The other of the cut pieces is a stabilizer 125, which is formed so as to project toward the bottom wall 121*c* from one 121*b*1 of the side walls. This stabilizer 125 also has a small-sized oval projection 125*a*. The projection 125*a* serves as a rib for reinforcing the stabilizer 125.

In the middle of the inwardly folded ceiling wall 121*a*2 out of the two ceiling walls 121*a*1 and 121*a*2 is an axially extending rectangular projection 126. The projection 126 shortens the height of the ceiling surface of the cylindrical portion. The peripheral edge of the shortened ceiling is sloped. Since the central part of the ceiling of the cylindrical portion comes down with the projection, stable current can flow through a male terminal fitting that comes in contact with the surface of the projection 126 reliably. Further, the slope of the ceiling surface guides the terminal fitting in a regular position although the terminal fitting is inserted obliquely. Still further, the height required for the insertion of the male terminal fitting can be shortened with respect to the height of the ceiling surface of the cylindrical portion, which is turn allows the height of the upper edge of the male terminal fitting insertion opening of a housing to be shortened when the terminal fitting 110 is inserted into the housing. As the height of the upper edge is shortened, the upper edge becomes shorter than the upper edge of the opening of the cylindrical portion at the time of inserting the male terminal fitting, and the male terminal fitting is thereby abutted against the peripheral edge of the cylindrical portion, thereby preventing the terminal fitting from being pushed out of the housing.

Figure 5:
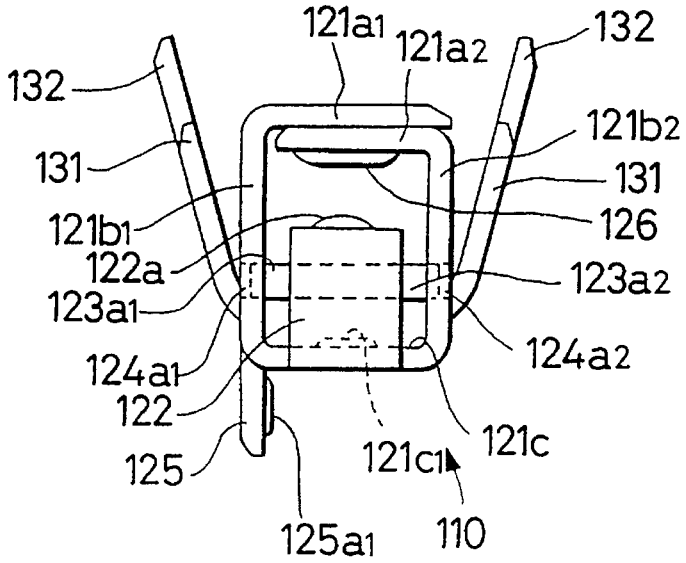
FIG. 5 is a front view of the terminal fitting.

In a crimping portion 130 continuous to the contact portion 120, a pair of wire barrels 131 are formed on the contact portion 120 side and a pair of insulation barrels 132 are formed on a portion remote from the contact portion 120. These portions are, as shown in FIG. 5, bent upward so as to be substantially U-shaped with the opening sides thereof being wider. The inner surfaces of the wire barrels 131 and insulation barrels 132 may be made rough to provide nonslip surfaces at the time of crimping.

Next, a fabrication method and mode of operation of the second embodiment having the aforementioned construction will be described.

As shown in FIG. 4, a metal strip is press-worked to form the respective projections 121*c*1, 122*a*, 125*a*1 and 126 and punch a developed blank along a contour. While the operation of bending the respective portions upward is, in reality, carried out integrally continuously in a subsequent process, such operation will be described individually to facilitate the understanding.

The ceiling wall 121*a*1 is bent upward by 90° with respect to the side wall 121*b*1, and the ceiling wall 121*a*2 is bent upward by 90° with respect to the side wall 121*b*2. Then, the reinforcing piece 123 is bent upward by 90° with respect to the bottom wall 121*c*, and the tongue piece 122 is folded by 180° from about the root portion thereof. In doing this operation, care must be taken to bend the front end 122*b* slightly downward so that the projection 122*b* and portions thereabout in the middle of the tongue piece 122 can be bent so as to be like a smoothly peaked roof. The front end 122*b* of the tongue piece 122 is thereafter bent upward to such an extent that the front end 122*b* is slightly biased onto the projection 121*c*1 of the bottom wall 121*c*. It should be noted that although the tongue piece 122 naturally spans the reinforcing piece 123 as the tongue piece 122 is bent upward in this way, a gap is interposed between the upper surface of the reinforcing piece 123 and the lower surface of the tongue piece 122.

The side walls 121*b*1 and 121*b*2 are then bent upward by 90° with respect to the bottom wall 121*c*. During this operation, the side walls 121*b*1 and 121*b*2 are bent upward while positioned so as to allow the engagement portions 123*a*1 and 123*a*2 of the reinforcing piece to be fitted into the engagement recesses 124*a*1 and 124*a*2 formed on the side walls 121*b*1 and 121*b*2, so that the engagement projections 123*a*1 and 123*a*2 are engaged with the engagement recesses 124*a*1 and 124*a*2 when the side walls 121*b*1 and 121*b*2 have been raised completely. When only the reinforcing piece 123 is simply bent upright with no engagement projections 123*a*1 and 123*a*2 and engagement recesses 124*a*1 and 124*a*2 provided, the reinforcing piece 123 may not, in some cases, take correct position because of an unstable amount of springback. The reinforcing piece 123 blocks the tongue piece 122 from flexing any further at such a limiting position as not to lose the spring characteristic when the tongue piece 122 flexes toward the bottom walls 121*c*. Therefore, if the reinforcing piece 123 is not in correct position and the tongue piece 122 thereby flexes to such a degree as to exceed the limit of resiliency, the tongue piece 122 may end up in losing the spring characteristic. However, in the present embodiment, the side walls 121*b*1 and 121*b*2 are press-worked to have the engagement recesses 124*a*1 and 124*a*2 formed in correct positions and the reinforcing piece 123 is press-worked to have the engagement projections 123*a*1 and 123*a*2 in correct positions, so that both the projections and the recesses can be engaged with each other during fabrication. Hence, the embodiment of the present device is free from any influence of unstable amount of springback and, therefore, can position the reinforcing piece 123 correctly as desired.

It should be noted that since the ceiling walls 121*a*1 and 121*a*2 come to overlap one upon another when the side walls 121*b*1 and 121*b*2 are bent upward by 90° with respect to the bottom wall 121*c*, the ceiling wall 121*a*2 on which the projection 126 is formed is folded inwardly. In addition, when the above operation is carried out, the wire barrels 131 and the insulation barrels 132 are bent upward by a predetermined angle simultaneously.

Figure 6:
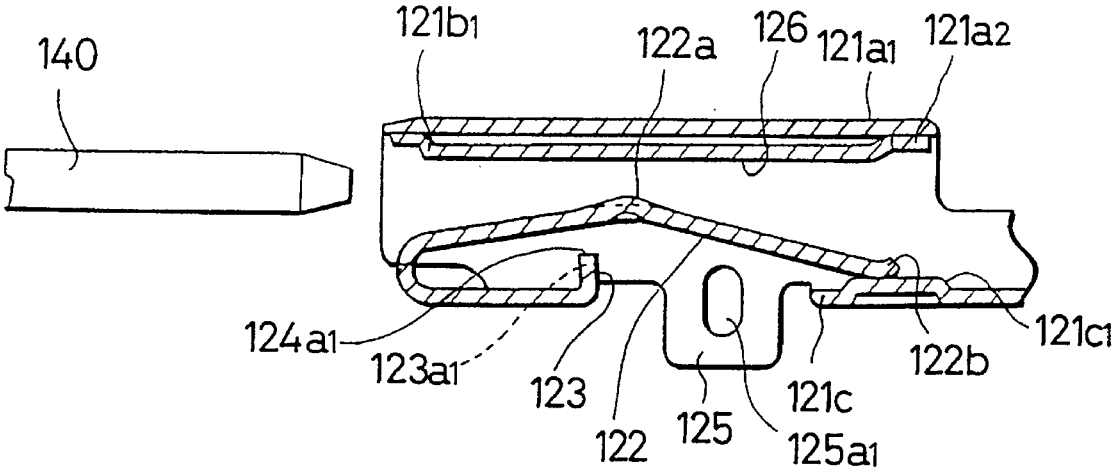
FIG. 6 is a partially sectional view showing a normal terminal fitting connecting process.
Figure 7:
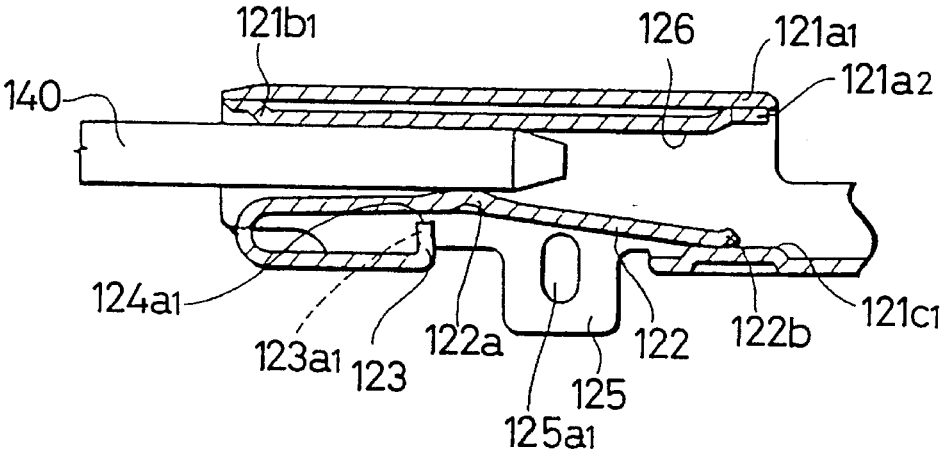
FIG. 7 is a partially sectional view showing a normal terminal fitting connecting process.
Figure 8:
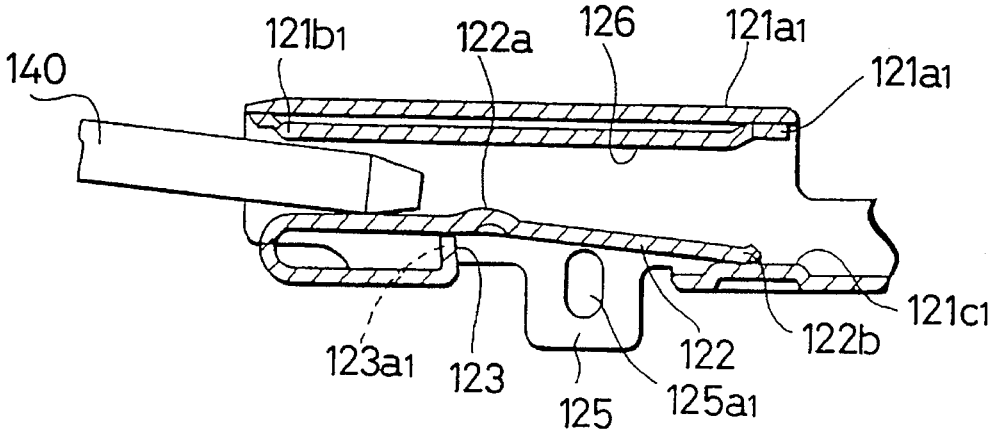
FIG. 8 is a partially sectional view showing an abnormal terminal fitting connecting process.

FIGS. 6 and 7 show processes of connecting such terminal fitting 110 to a male terminal fitting 140. To insert the male terminal fitting 140 horizontally from a condition of FIG. 6 to a condition of FIG. 7, a gap exists between the upper side of the reinforcing place 123 and the tongue piece 122. Therefore, as shown in FIG. 8, when the male terminal fitting 140 is inserted obliquely, the tongue piece 122 tends to flex more than expected to be abutted against the upper surface of the reinforcing piece 123. In this case, if the reinforcing piece 123 stands upright while simply bent, the reinforcing piece 123 easily flexes together with the tongue piece 122, causing the tongue piece 122 to lose the spring characteristic and thereby making the reinforcing piece 123 itself useless. Therefore, if the reinforcing piece 123 is supported by both the engagement projections 123*a*1, 123*a*2 projecting from the side surfaces of the reinforcing piece 123 and the engagement recesses 124*a*1 and 124*a*2 on the side walls 121*b*1 and 121*b*2 with the former fitted into the latter as in the case of this embodiment, the reinforcing piece 123 can support the tongue piece 122 from below without being deformed by a larger load. As a result, the tongue piece 122 does not flex so largely as to lose the spring characteristic that the terminal fitting 110 can be used again as long as the male terminal fitting 140 is removed therefrom.

As described above, the engagement projections 123*a*1, 123*a*2 are formed on the side surfaces of the reinforcing piece 123 that project from the bottom wall 121*c*, whereas the engagement recesses 124*a*1 and 124*a*2 engageable with the engagement projections 123*a*1 and 123*a*2 are formed on the side walls 121*b*1 and 121*b*2 that are bent upright at the sides of the bottom wall 121*c*, so that both projections and recesses can be engaged with each other when the side walls 121*b*1 and 121*b*2 are bent upright. Therefore, not only the strength of the reinforcing piece 123 can be improved with the support from both sides, but also the reinforcing piece 123 can be held in correct position. In addition, any mode of engagement may be selected as long as the side walls 121*b*1, 121*b*2 stand upright in contact with the reinforcing piece 123 so as to be engageable with the reinforcing piece 123, in other words.

A third embodiment of the invention will be described with reference to FIGS. 9 to 12.

Figure 9:
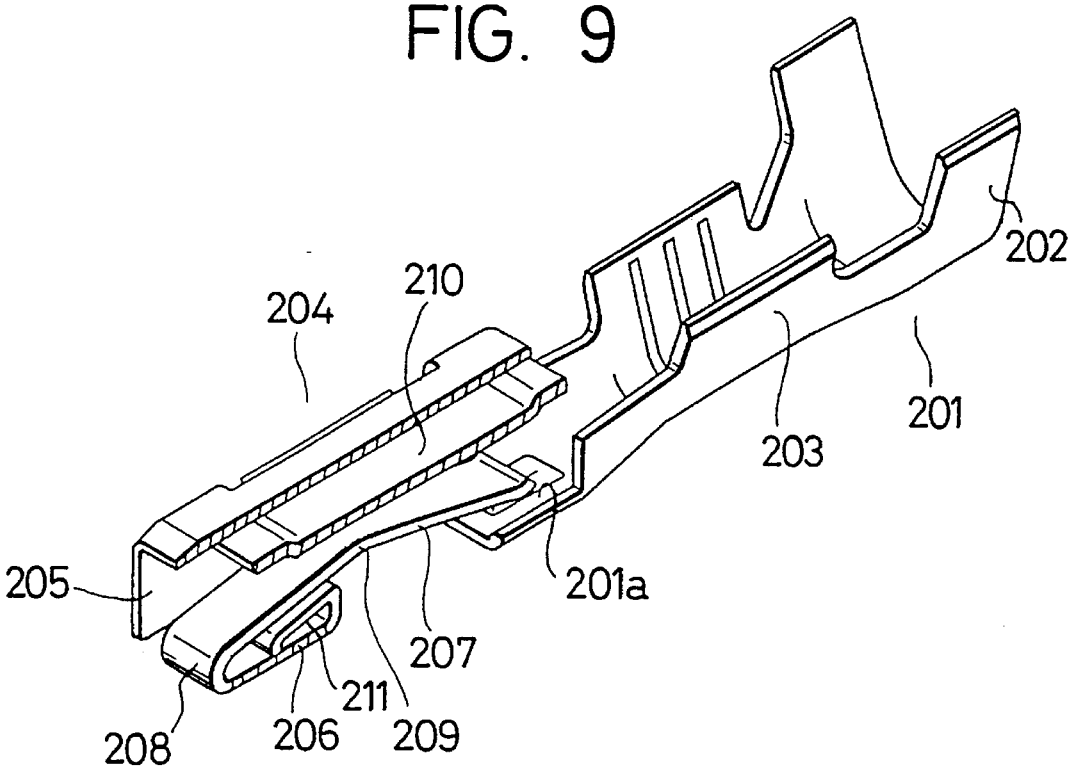
FIG. 9 is a partially cutaway perspective view of the third embodiment of the present invention.
Figure 10:
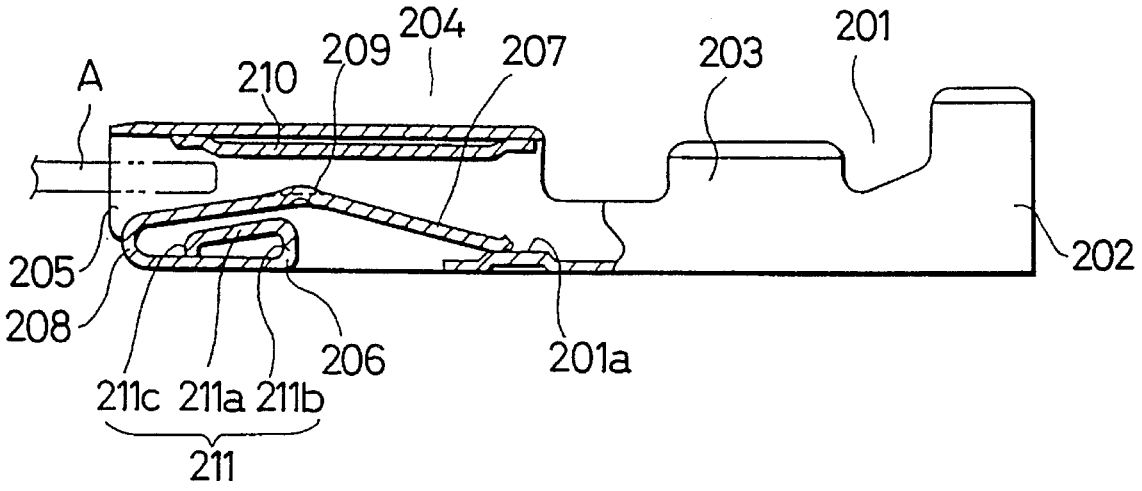
FIG. 10 is a partially longitudinal sectional view thereof.

A female terminal fitting for a connector, which is the third embodiment, is made of an electrically conducting thin metal plate. The female terminal fitting is formed by punching the metal plate into a predetermined shape and then by bending the punched blank at predetermined positions, so that an electrical wire attaching portion 201 and a cylindrical insertion portion 204 for allowing a male terminal to be inserted thereinto are formed as shown in FIG. 9.

The electrical wire attaching portion 201 has a coated wire crimping piece 202 for crimping a not shown coated electrical wire, and a conductor crimping piece 203 for crimping conductors at an end portion of the electrical wire which is stripped off.

Further, the cylindrical insertion portion 204 is formed into a cylindrical member that is square in section with a front end opening 205 for receiving a male terminal fitting A (see FIG. 10) arranged at the front end thereof. A resilient contact piece 207 extending into the hollow from the front end opening 205 is formed integrally with the cylindrical insertion portion 204.

The width of the resilient contact piece 207 is set to a predetermined value that is slightly narrower than the width of the hollow of the cylindrical insertion portion 4. The resilient contact piece 207 has a fold 208 that is formed by folding the resilient contact piece rearward from the front end edge of a lower side wall portion 206 so as to be slightly upward. Further, a contact portion 209 forming the top of a mountainous portion by bending downward the resilient contact piece midway. A gap slightly narrower than the thickness of the male terminal fitting A is thus provided between the contact portion 209 and an upper side wall portion 210 of the cylindrical insertion portion 204. The front end of the resilient contact piece 207 is disposed in contact with the bottom portion 201*a* of the lower side wall portion 206.

Accordingly, the resilient contact piece 207 is given resiliency (the spring characteristic) at the fold 208 thereof. Therefore, when the male terminal fitting A is inserted, the contact portion 209 causes the male terminal fitting A to come in resilient contact with the inner wall side of the upper side wall portion 210 to thereby clamp the male terminal fitting.

In addition, the lower side wall portion 206 located substantially below the contact portion 209 is cut, and this cut part is bent upward to form a stopper 211. The stopper 211 includes: a support piece 211*b* bent upward from the lower side wall portion 206; a support surface 211*a* formed by bending the front end of the support piece 211*b* substantially perpendicularly toward the front end opening 205; and a support piece 211*c* formed by further bending the front end of the support surface 211*a* toward the lower side wall portion 206. As a result of this construction, the stopper 211 is formed into a bench-like member that is C-shaped in section. The front end of the support piece 211*c* is formed so as to be almost in contact with the lower side wall portion 206. The support surface 211*a* is disposed so as to confront the back of a portion between the fold 208 and contact portion 209 of the resilient contact piece 207.

Figure 11:
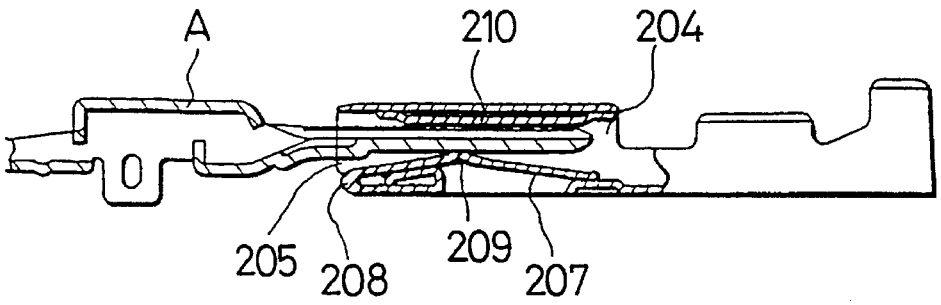
FIG. 11 is a partially longitudinal sectional view thereof with a male terminal fitting inserted.

In the construction of this embodiment, when the standard male terminal fitting A is inserted from the front end opening 205 of the cylindrical insertion portion 204 as shown in FIG. 11, the female terminal fitting flexes the fold 208 in association with the insertion to clamp the male terminal fitting A between the contact portion 209 and the upper side wall portion 210 of the cylindrical insertion portion 204. As a result, reliable electrical contact between the female terminal fitting and the male terminal fitting A can be ensured.

Figure 12:
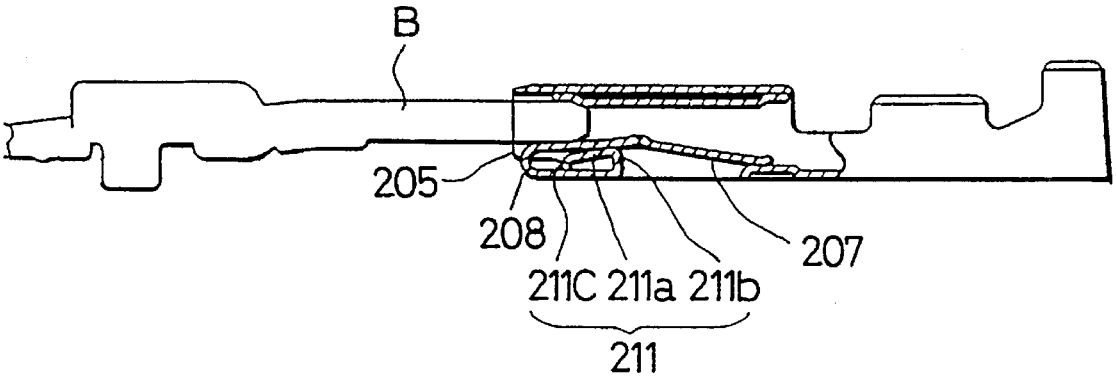
FIG. 12 is a partially longitudinal sectional view thereof with a foreign object inserted.

On the other hand, as shown in FIG. 12, a foreign object (e.g., a nonstandard male terminal fitting and a screwdriver) B that is thicker than the standard male terminal fitting A is inserted from the front end opening 205, the resilient contact piece 207 flexes the fold 208 thereof. However, the resilient contact piece 207 is abutted against the support surface 211*a* of the stopper 211 with the amount of flexion thereof being within the limit of resiliency thereof. This accordingly blocks the fold 208 from further flexing, thereby not causing such an amount of flexion as to exceed the limit of resiliency and to cause settling by which the fold 208 loses resiliency.

If a large force is applied to the foreign object B, the stopper 211 receives the large force through the resilient contact piece 207. At this time, the stopper 211, whose rigidity is improved while supported by the support pieces 211*b* and 211*c* at both sides of the support surface 211*a* in a bench-like manner, can support the resilient contact piece 207 against the large force by the support surface 211*a* without causing the support pieces 211*b* and 211*c* to fall. Since the support surface 211*a* supports the resilient contact piece 207 not by point contact but by surface contact, the resilient contact piece 207 can be supported so as not to be bent or collapsed by a local stress. It should be noted that the front end of the support piece 211*c* may not necessarily be supported by the lower side wall portion 206 directly; the support piece 211*c* may be formed so as to be supported by the lower side wall portion 206 while deformed as the support surface 211*a* is slightly biased.

The fourth embodiment of the present invention will be described with reference to FIGS. 16 and 17.

A female terminal fitting 310 of the present invention is designed to be inserted into a cavity 303 formed within a connector housing 302 of a connector 301 and engaged with a tab 309 of a male terminal fitting attached to a not shown mating connector housing so as to be electrically connected thereto. A specific structure of the female terminal fitting 310 will be described below.

The female terminal fitting 310 is formed by punching an electrically conducting metal strip into a predetermined shape and bending the punched blank at predetermined positions. A portion on the rear side is a connecting section 311 that is opened upward as viewed in the drawings. Conductors 308 exposed by unsheathing an electrical cable 307 is crimped by caulking at the connecting section 311.

On the other hand, a portion on the front side of the female terminal fitting 310 is a cylindrical insertion portion 312 that is square in section as a whole. A wall plate on the upper side as viewed in the drawings (hereinafter referred to as "upper wall plate") 313 of the cylindrical insertion portion 312 has two overlapping walls 313*a* and 313*b* formed by bending the upper edges of the wall plates on both sides inward. A large opening to the outside is provided over almost all the front end surface of the cylindrical insertion portion 312, constituting an insertion opening 314 that allows a male terminal fitting to be inserted thereinto. The insertion opening 314 is designed to be aligned with and abutted against the inner side of a connecting opening 305 that is open at the front end of the connector housing 302.

A resilient contact piece 316 is provided within the hollow of the cylindrical insertion portion 312. The resilient contact piece 316 extends from a wall plate on the lower side as viewed in FIG. 17 (hereinafter referred to as "lower wall plate") and is integrated with the female terminal fitting 310. The resilient contact piece 316 includes a fold 316A and an extending portion 316B extending rearward from the fold 316A, the fold 316A being formed by folding a part of the female terminal fitting rearward from the front end edge of the lower wall plate 316. The extending portion 316B takes a mountainous form as a whole while slightly curved in the middle in the longitudinal direction thereof, and the extending end thereof is in resilient contact with the lower wall plate 315. In addition, the curved portion in the middle of the extending portion 316B serves as a contact portion 316C that comes in contact with the tab 309 of the male terminal fitting. When the resilient contact piece 316 is in a free condition, a gap is provided between the contact portion 316C of the resilient contact piece 316 and the upper wall plate 313, the gap being slightly narrower than the thickness of the tab 309 of the male terminal fitting.

A stopper 317 is arranged in the cylindrical insertion portion 312 to block the resilient contact piece 316 from flexing to such a degree as to exceed the limit of resiliency thereof. The stopper 317 is implemented by a projection formed by bending the lower wall plate 315 upward from the edge portion of a lance hole 318 arranged on the lower wall plate 315. The front end of the stopper 317 confronts the back (the lower surface) of the extending portion 316B of the resilient contact piece 316 with a gap interposed therebetween when the resilient contact piece 316 is in the free condition.

It should be noted that the lance hole 318 is provided to allow a lance 304 disposed on the connector housing 302 to be inserted thereinto. With the lance 304 retained at the front end edge of the lance hole 318, i.e., the base end of the stopper 317, the female terminal fitting 310 can be held unremovably with the cavity 303.

A guide portion is provided in the cylindrical insertion portion 312 to guide the tab 309 of the male terminal fitting in a direction of insertion into the cylindrical insertion portion 312. A structure of the guide will be described below.

Figure 17:
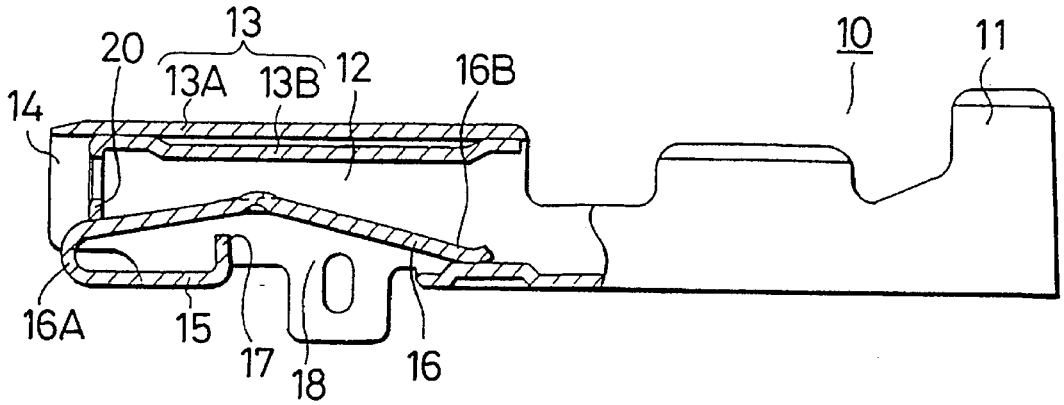
FIG. 17 is a sectional view of the fourth embodiment.

As shown in FIG. 17, the inner wall plate 313B out of the doubly folded wall plates 313A and 313B that constitute the upper wall plate 313 of the cylindrical insertion portion 312 has a bent plate portion 320 with the front end portion thereof bent downward. The bent plate portion 320 is positioned slightly rearward with respect to the insertion opening 314, and the plate surface extends at right angles to the direction of insertion of the male terminal fitting. The bent plate portion 320 has an insertion hole 321 whose opening is slightly larger than the outer diameter of the cab 309 of the male terminal fitting and which serves as a regulating member formed by the opening edge. As a result of such construction, when the tab 309 of the male terminal fitting is inserted obliquely from the connecting opening 305, the tip of the tab 309 is abutted against the bent plate portion 320 to block further insertion thereof or the oblique insertion thereof is corrected by the insertion hole 321 to thereby guide the tip along a predetermined path of insertion.

Next, a mode of operation of the aforementioned embodiment will be described.

Figure 16:
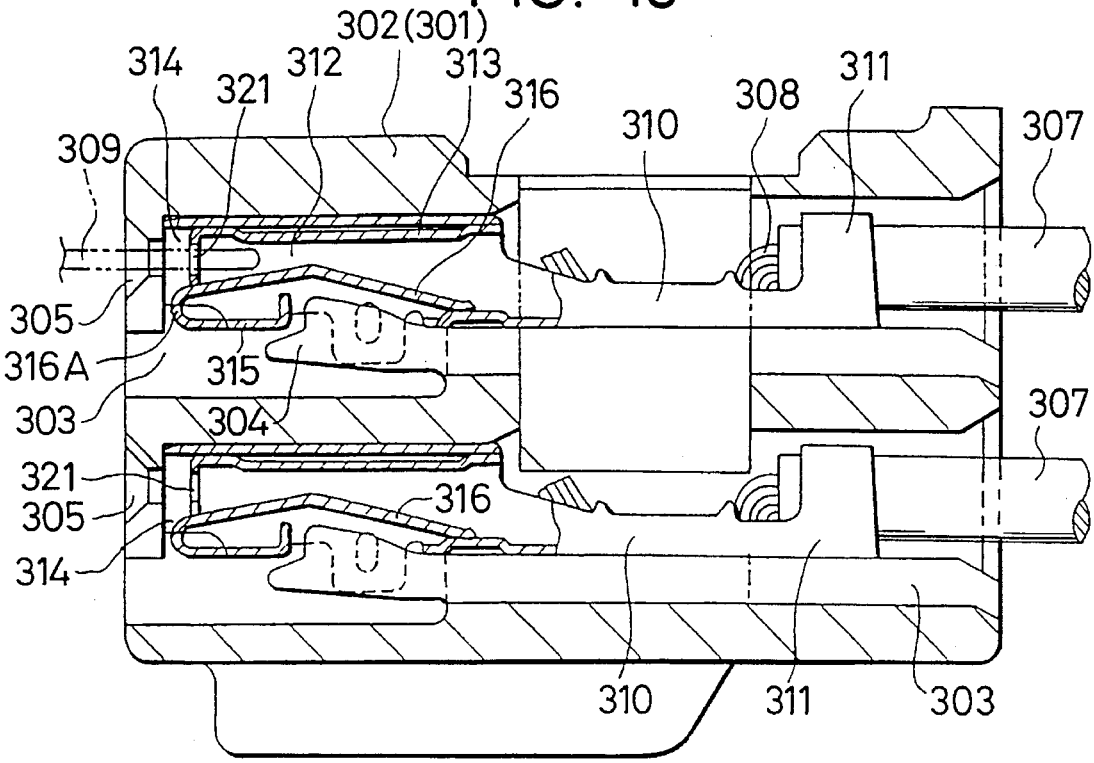
FIG. 16 is a sectional view of female terminal fittings, which is a fourth embodiment of the present invention, attached to a connector.

As shown in FIG. 16, at the time the female terminal fitting 310 attached to the cavity 303 of the connector housing 302 is connected to the male terminal fitting, the tab 309 of the male terminal fitting is inserted by passing through the connecting opening 305 of the connector housing 302, the insertion opening 314 at the front end of the cylindrical insertion portion 312, and the insertion hole 321 in this order. The tab 309 enters into a space between the contact portion 316C of the resilient contact piece 316 and the upper wall plate 313 thereafter, and is clamped by resiliency of the resilient contact piece. As a result, the male terminal fitting and the female terminal fitting are electrically connected.

If the tab 309 is inserted while largely inclined obliquely with respect to the connecting opening 305, then the tip of the tab 309 gets abutted against the bent plate portion 320 to have the insertion thereof blocked. If the tip of the tab 309 is inserted into the insertion hole 321 even though the tab 309 is inclined obliquely, the direction of insertion of the tab 309 is rectified as the tab 309 passes through both the connecting opening 305 of the connector housing 302 and the insertion hole 321 of the cylindrical insertion portion 312 that serve to regulate the path of the tab 309. As a result, such insertion as to cause settling at the fold 316A with the tab 309 being abutted against the extending portion 316B inclined at a large angle can be prevented. Hence, it is not likely that the resilient contact piece 316 will lose the proper spring characteristic thereof, and this in turn allows the resilient contact piece 316 and the tab 309 to come in contact with each other at a predetermined contact pressure and thereby ensures reliable electrical contact between the male terminal fitting and the female terminal fitting 310.

It should be noted that any foreign object that is thicker than the tab 309 is never admitted while abutted against the peripheral surface of the insertion hole 321. Therefore, the likelihood that the resilient contact piece 316 will flex to such a degree as to exceed the limit of resiliency thereof due to entrance of a foreign object that is thicker than the tab 309 is excluded. As a result, the present device can prevent the resilient contact piece 316 from losing the proper spring characteristic thereof.

Figure 18:
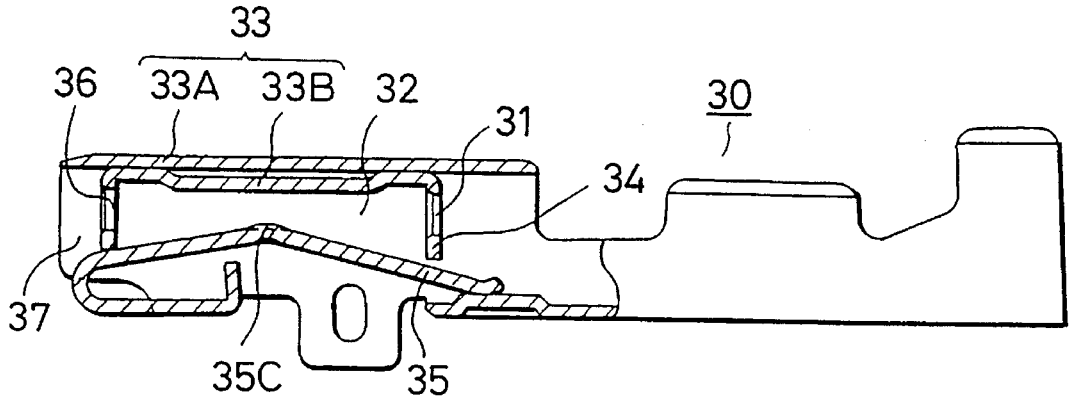
FIG. 18 is a sectional view of a fifth embodiment.
Figure 19:
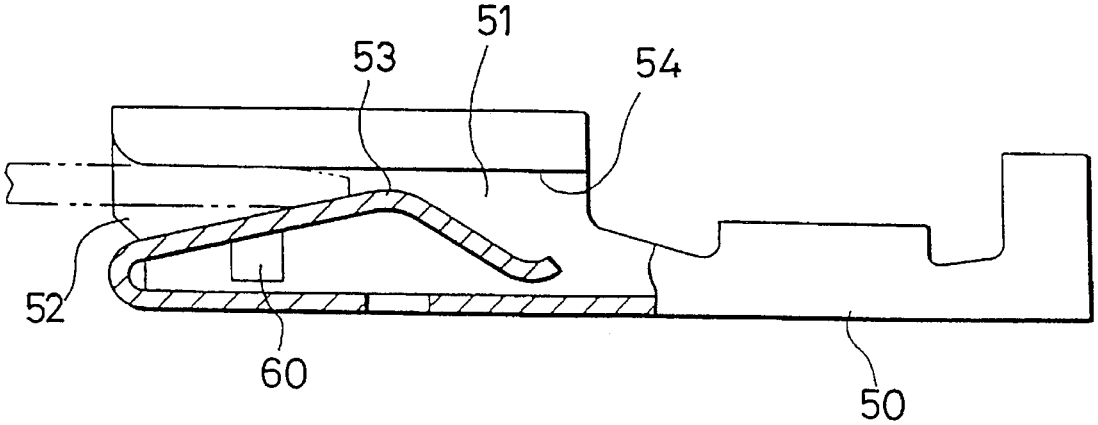
FIG. 19 PRIOR ART
FIG. 19 is a partially cutaway side view of a conventional example.
Figure 20:
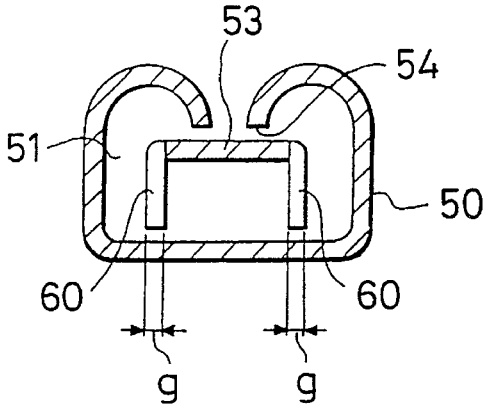
FIG. 20 PRIOR ART
FIG. 20 is a longitudinal sectional view of the conventional example.
Figure 21:
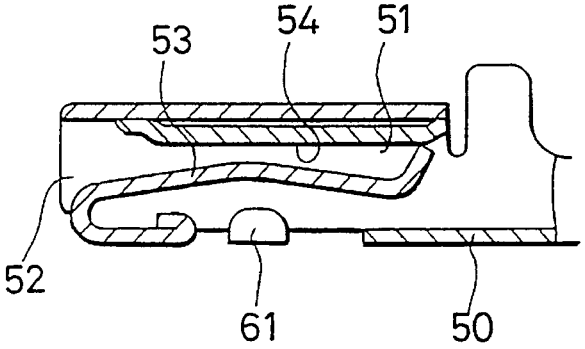
FIG. 21 PRIOR ART
FIG. 21 is a partially cutaway side view of the conventional example.
Figure 22:
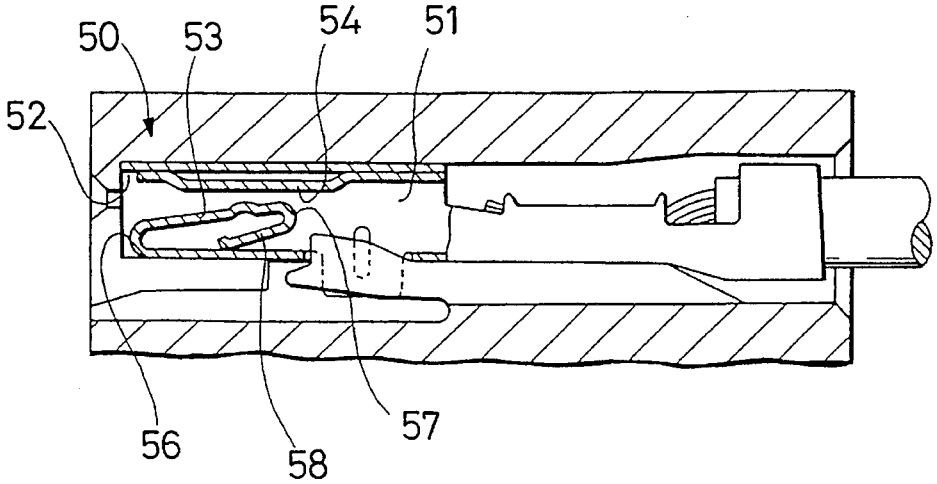
FIG. 22 PRIOR ART
FIG. 22 is a longitudinal sectional view of the conventional example.
Figure 23:
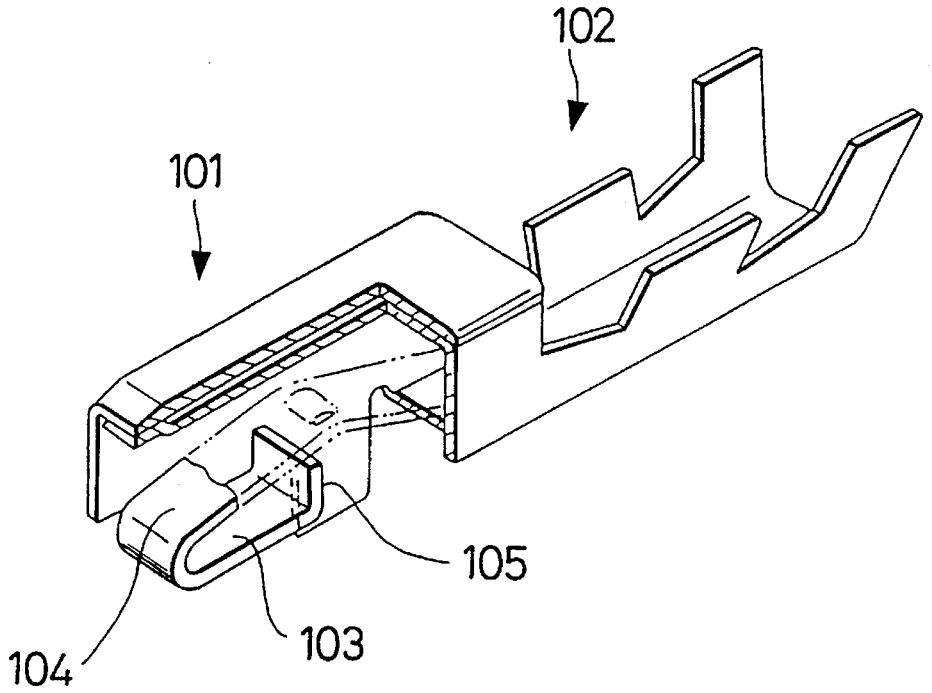
FIG. 23 PRIOR ART
FIG. 23 is a partially cutaway perspective view of another conventional terminal fitting.
Figure 24:
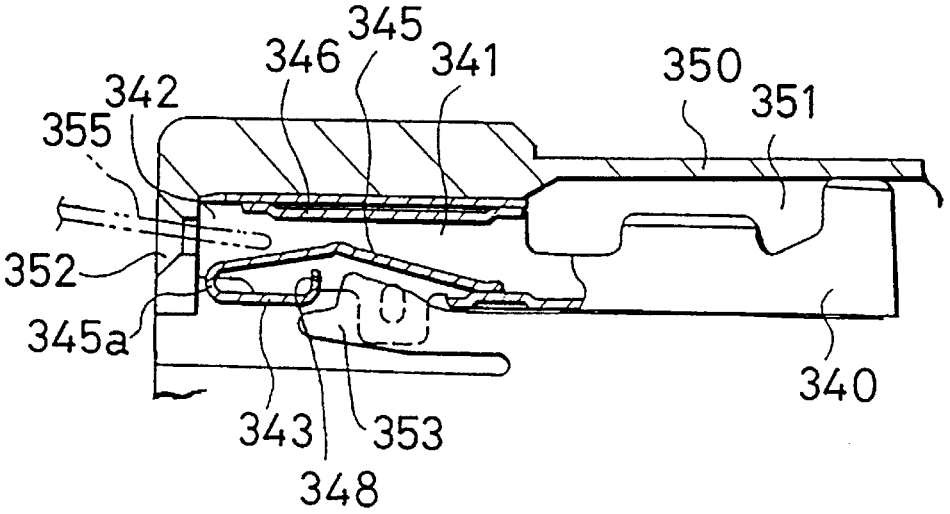
FIG. 24 PRIOR ART
FIG. 24 is a sectional view of another conventional example.

The fifth embodiment of the present invention will be described with reference to FIG. 18.

A female terminal fitting 330 has an auxiliary regulating member 331 in addition to the same structure as the female terminal fitting 310, which is the fourth embodiment. The auxiliary regulating member 331 is formed by bending downward a rear end portion of a wall plate 333B out of doubly overlapping wall plates 333A and 333B that constitute an upper wall plate 333 of a cylindrical insertion portion 332 and by opening the thus formed bent plate portion 334 so as to be slightly larger than the tab of a male terminal fitting. This auxiliary regulating member 331 is positioned rearward with respect to a contact portion 335*c* of a resilient contact piece 335 which comes in contact with the tab of the male terminal fitting.

A regulating member 336 that is formed in the same way as that of the female terminal fitting 310, which is the fourth embodiment, is arranged on the front end portion of the wall plate 333B that has the auxiliary regulating member 331 formed thereon. Both the regulating member 336 and the auxiliary regulating member 331 are arranged on a line of insertion of the tab of the male terminal fitting.

To connect the female terminal fitting 330, which is the fifth embodiment, and the male terminal fitting to each other, the tab of the male terminal fitting sequentially passes through a connecting opening of a not shown connector housing, an insertion opening 337 of the cylindrical insertion portion 332, and the regulating member 336, is clamped between the contact portion 335C of the resilient contact piece 335 and the upper wall plate 333, and is thereafter fitted into the auxiliary regulating member 331. While the tab is being fitted into the auxiliary regulating member 331, the direction of insertion of the tab is corrected by the regulating member 336, and the tip of the tab 309 is finely rectified by the auxiliary regulating member 331, so that the force applied to the resilient contact piece 335 that urges the tab 309 onto the wall plate 333B can be reduced. Particularly, even if vibration is applied to the connector, stable electrical contact can be obtained, since the amount of vibration causing the tip of the tab 309 to move vertically is regulated.

It should be noted that while the contact portion 120 is formed to be cylindrical so as to be surrounded in all directions in the second embodiment, a terminal fitting having no ceiling walls 121*a*1 and 121*a*2 and having the tongue piece 122 projected upward so as to be raised higher than the side walls 121*b*1 and 121*b*2 may be acceptable. In addition, since the reinforcing piece in the embodiment is supported by the engagement projections 123*a*1 and 123*a*2 of a projected structure being fitted into the engagement recesses 124*a*1 and 124*a*2 of a hole structure, the reinforcing piece 123 is supported in all directions, up and down, and front and back. However, if the reinforcing piece 123 is supported with projections and recesses combined so as to match the direction in which force is applied, then the structures thereof are not limited to projections and holes.

It should also be noted that the present device is not limited to the aforementioned embodiment as long as the rigidity of the stopper is increased with the stopper being C-shaped in section by the support surface and the support pieces at both sides of the support surface. Therefore, the following modifications may be made.

Figure 13:
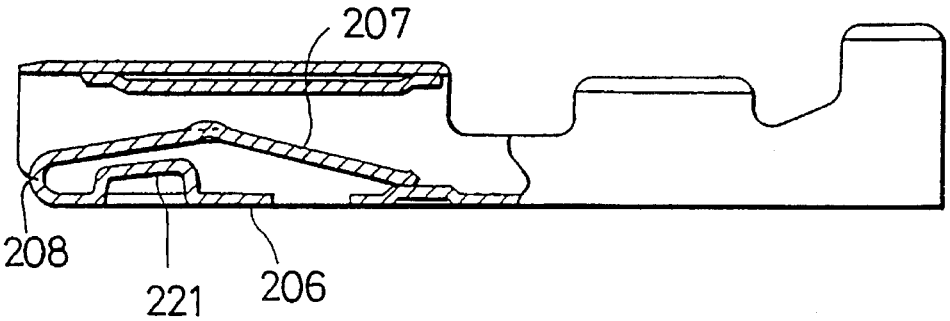
FIG. 13 is a partially longitudinal sectional view of another embodiment.

(1) While the stopper 211 of the third embodiment is formed by bending the cut part upward from the lower side wall portion 206, such a stopper 221 as shown in FIG. 13 characterized as stretching out the lower side wall portion 206 inward may be applicable.

Figure 14:
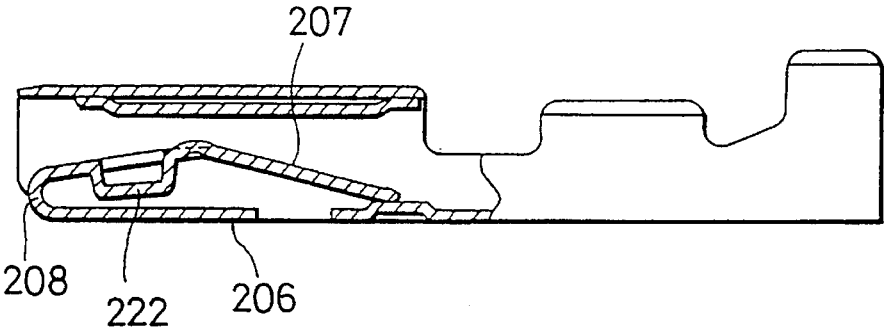
FIG. 14 is a partially longitudinal sectional view of still another embodiment.

(2) While the example in which the stopper 211 is disposed on the lower side wall portion 206 of the cylindrical insertion portion 204 has been described in the third embodiment, a stopper 222 may be arranged on the resilient contact piece 207 side as shown in FIG. 14.

Figure 15:
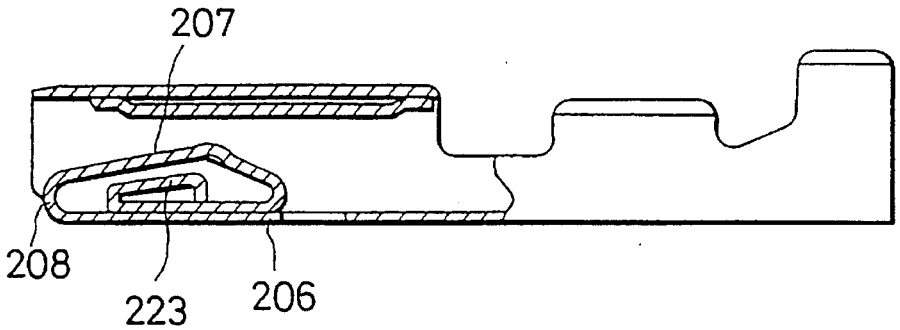
FIG. 15 is a partially longitudinal sectional view of still another embodiment.

(3) Further, as shown in FIG. 15, the resilient contact piece 207 may be an elongated piece, and a stopper 223 may be formed by folding the front end of such elongated resilient contact piece 207 is C form.

It should be noted that the present device is not limited to the embodiment that is described above and shown in the drawings, but may be embodied in various modes without departing from the spirit thereof.

What is claimed is:

1. A female terminal fitting for a connector comprising:

a cylindrical insertion portion whose front end is and a resilient contact piece is disposed within said cylindrical insertion portion, said resilient contact piece including, a first fold being formed by extending an extending end portion from a wall portion of said cylindrical insertion portion and folding the extending end portion back into a hollow of the cylindrical insertion portion, said first fold being given resiliency, a second fold being formed by further folding the extending end portion inward, said second fold being given resiliency, and a stopper for regulating an amount of flexure of said resilient contact piece, said stopper being formed by bending the extending end portion of said second fold so as to confront a back surface between said first fold and said second fold, wherein a male terminal fitting is retained in pressure contact with said resilient contact piece by inserting said male terminal fitting into said cylindrical insertion portion.

2. A terminal fitting, comprising:

side walls formed by bending side portions of a bottom wall of a contact portion coming in contact with a mating terminal upright so that the contact portion is surrounded in three directions;

a reinforcing piece formed by cutting and bending upright a portion of the bottom wall, said reinforcing piece standing substantially perpendicular to the bottom wall;

projections formed on sides of said reinforcing piece;

recesses engageable with said projections formed on portions of said side walls confronting said projections; and a band-like abutment portion extending from a front end of the bottom wall, said abutment portion being bent so as to extend over said reinforcing piece while interposed between both sides.

3. The terminal fitting according to claim 2, wherein said contact portion is formed so as to be cylindrical.

4. A female terminal fitting for a connector, comprising:

a cylindrical insertion portion into which the male terminal fitting is inserted from a front end opening of said cylindrical insertion portion;

a resilient contact piece having a contact portion serving to clamp the male terminal fitting together with an inner wall of said cylindrical insertion portion; and a stopper serving to regulate an amount of flexure of the resilient contact piece, wherein, said resilient contact piece has at least one acute angled bend, said stopper being formed by a C-shaped portion of said resilient contact piece having a support surface and support pieces at sides of the support surface, the stopper extending up from a lower wall of said female terminal fitting so that the support surface is engageable with said contact portion.

5. A female terminal fitting for a connector, the connector having a connecting opening, said female terminal fitting comprising:

a cylindrical insertion portion having an insertion opening formed at a front end thereof and containing a resilient contact piece therein, said female terminal fitting being electrically connected to a male terminal fitting of a mating connector by allowing the male terminal fitting of the mating connector to be inserted into said cylindrical insertion portion via the connecting opening of the connector and said insertion opening while connected to the connector; and a regulating member for regulating a direction of insertion of the male terminal fitting into said cylindrical insertion portion, said regulating member being disposed at a position on said insertion opening side of said cylindrical insertion portion, wherein said regulating member is formed of a bent plate portion being bent and extended from a wall plate of said cylindrical insertion portion, and said bent plate portion has an insertion hole extending through a planar surface of said bent plate portion for allowing the male terminal fitting to be inserted there into.

6. The female terminal fitting for a connector according to claim 5, wherein an auxiliary regulating portion for supporting a tip of the male terminal fitting inserted into the cylindrical insertion portion is disposed at a position opposite to said insertion opening of said cylindrical insertion portion.

7. A female terminal fitting for a connector, comprising:

a cylindrical insertion portion into which the male terminal fitting is inserted from a front end opening of said cylindrical insertion portion;

a resilient contact piece having a contact portion serving to clamp the male terminal fitting together with an inner wall of said cylindrical insertion portion; and a stopper serving to regulate an amount of flexure of the resilient contact piece, wherein said stopper is formed by a C-shaped depression in the contact portion between ends thereof and is engageable with a lower wall of said female terminal fitting.

* * * * *